US005347726A

United States Patent [19]

Quadracci et al.

[11] Patent Number: 5,347,726

[45] Date of Patent: Sep. 20, 1994

[54] METHOD FOR REDUCING CHILL ROLL CONDENSATION

[75] Inventors: H. Richard Quadracci, New York, N.Y.; Karl R. Voss, Wauwatosa; Jeffrey W. Sainio, Hartland, both of Wis.

[73] Assignee: Quad/Tech Inc., Sussex, Wis.

[21] Appl. No.: 997,888

[22] Filed: Dec. 29, 1992

Related U.S. Application Data

[60] Division of Ser. No. 759,392, Sep. 13, 1991, Pat. No. 5,184,555, which is a continuation-in-part of Ser. No. 503,711, Apr. 3, 1990, Pat. No. 5,056,431, which is a continuation-in-part of Ser. No. 340,498, Apr. 19, 1989, Pat. No. 4,913,049.

[51] Int. Cl.[5] ..... F26B 3/00

[52] U.S. Cl. ..... 34/465; 34/640; 34/653

[58] Field of Search ..... 34/13, 17, 18, 60, 155, 34/156, 160, 23

[56] References Cited

U.S. PATENT DOCUMENTS

| | | | |
|---|---|---|---|
| 2,306,607 | 12/1942 | Hopton | 101/424.1 |
| 2,848,820 | 8/1958 | Wallin et al. | 226/97 |
| 3,147,006 | 9/1964 | Fulk | 101/227 |
| 3,448,907 | 6/1969 | Otepus et al. | 226/97 |
| 3,469,275 | 9/1969 | DeSchuttere et al. | 19/306.1 |
| 3,549,070 | 12/1970 | Frost et al. | 226/97 |
| 3,622,058 | 11/1971 | Vits | 226/7 |
| 3,628,454 | 12/1971 | Eberly, Jr. | 101/147 |
| 3,650,043 | 3/1972 | Overly et al. | 226/97 |
| 3,979,038 | 9/1976 | Karlsson | 226/97 |
| 4,038,917 | 8/1977 | Deligt | 226/7 |
| 4,069,595 | 1/1978 | Ahlbert et al. | 226/97 |
| 4,074,841 | 2/1978 | Kramer et al. | 226/97 |
| 4,096,801 | 6/1978 | Martin | 101/227 |
| 4,137,644 | 2/1979 | Karlsson | 226/7 |
| 4,142,661 | 3/1979 | Nettles et al. | 226/97 |
| 4,201,323 | 5/1980 | Stibbe et al. | 226/97 |
| 4,240,346 | 12/1980 | Landis et al. | 101/225 |
| 4,308,984 | 1/1982 | Vits | 226/97 |
| 4,321,107 | 3/1982 | Page | 226/7 |
| 4,342,413 | 8/1982 | Reba | 226/7 |
| 4,366,753 | 1/1983 | Glanz et al. | 101/227 |
| 4,406,388 | 9/1983 | Takashi et al. | 226/97 |
| 4,414,757 | 11/1983 | Whipple | 226/97 |
| 4,453,709 | 6/1984 | Reba | 226/7 |
| 4,472,888 | 9/1984 | Spiller | 226/97 |
| 4,541,337 | 9/1985 | Schaul | 101/227 |
| 4,601,116 | 7/1986 | Krimsky | 226/97 |
| 4,697,542 | 10/1987 | Kohler et al. | 15/309.1 |
| 4,698,914 | 10/1987 | Shu et al. | 226/97 |
| 4,787,547 | 11/1988 | Hella et al. | 226/97 |
| 4,787,986 | 11/1988 | Daane et al. | 226/97 |
| 5,174,047 | 12/1992 | Gross | 34/13 |

FOREIGN PATENT DOCUMENTS

| | | | |
|---|---|---|---|
| 2150986 | 1/1980 | Fed. Rep. of Germany | 101/424.1 |
| 3241117 | 4/1984 | Fed. Rep. of Germany | 101/424.1 |
| 0089368 | 5/1983 | Japan | 101/424.1 |
| 0277542 | 12/1986 | Japan | 226/97 |
| 1244263 | 8/1971 | United Kingdom | 101/423 |
| 2017056 | 8/1979 | United Kingdom | 226/97 |

OTHER PUBLICATIONS

"High Speed Air Drying" by T. A. Gardner, Printing Magazine, *National Lithographer*, vol. 87, Oct. 1963, pp. 116–117, 136.

"High Velocity Drying" by H. A. Buntrocu, *The Graphic Arts Monthly*, vol. 35, No. 4, Apr. 1963, pp. 82, 84, 86, 88, 90, 92, 94.

Three page Bertin & Cie brochure entitled "Calgraph Systeme" Control de reperage (Register Control), Apr. 7, 1989.

*Primary Examiner*—Henry A. Bennett

*Attorney, Agent, or Firm*—Michael, Best & Friedrich

[57] ABSTRACT

An apparatus for dispersing contaminants from the surface of a web moving in a processing direction within a web processing system, the web processing system including a web processing structure, the apparatus including a chill roll air bar disposed proximate to a surface of the web, for separating the contaminated air from the surface of the web before that surface of the web engages the processing structure.

2 Claims, 5 Drawing Sheets

METHOD FOR REDUCING CHILL ROLL CONDENSATION

This is a division of co-pending application Ser. No. 759,392 filed Sep. 13, 1991, entitled "Apparatus For Reducing Chill Roll Condensation" now U.S. Pat. No. 5,184,555.

Which is a continuation-in-part application from co-pending U.S. patent application Ser. No. 07/503,711 filed Apr. 3, 1990, which is a continuation-in-part application from U.S. patent application Ser. No. 07/340,498 filed Apr. 19, 1989, having issued as U.S. Pat. No. 4,913,049 on Apr. 3, 1990.

TECHNICAL FIELD

The present invention relates, generally, to mechanisms for reducing chill streaking problems on a web in multicolor web-fed printing press systems by preventing formation of chill roll solvent condensation. More particularly, the present invention is related to methods and apparatus for non-invasively reducing condensate streaking on the web without contacting the web or the chill roll, thereby improving the quality of the printed product at high press speeds.

BACKGROUND OF THE INVENTION

In multicolor web-fed printing press systems, a web of material (e.g., paper) is sequentially driven through a series of printing units, each comprising a plate cylinder and a print cylinder (blanket cylinder). Each blanket cylinder contacts the web in sequence and applies a different color of ink thereto, which colors cooperate to imprint a multicolor image on the web. As the web exits the printing units, the ink is still wet, and thus subject to smearing. Accordingly, for further processing, the web is typically routed through a drying unit to dry the image, heating the web to evaporate various solvents in the ink, then to a chill roller unit to cool the web and harden the ink.

To provide an accurate and clear multicolor image, the rotational and lateral position of each blanket cylinder must be precisely aligned, i.e., proper registration of the respective colors must be maintained. Sources of inaccurate color registration include web "weave" (spurious lateral movement of the web, e.g., movement transverse to the direction of web travel, in the plane of the web) and web "flutter" (spurious movement of the web in a direction perpendicular to the plane of the web).

Other factors may also affect print quality. More particularly, the printed web may display streaking marks as the web exits the chill roller unit. It is generally accepted that this web streaking problem, commonly called "chill streaking" or "condensate marking", is caused by the formation of a contaminant condensate film typically on the first roller of the chill roller unit.

In order to dry the image printed on a web, the drying unit heats the web which evaporates various solvents in the ink. The majority of the contaminated warm air, which contains evaporated ink solvents and gases from the combustion in the drying unit as well as evaporated moisture from the web, is directed through an exhaust system comprising pollution control devices designed to eliminate the contaminants from the warm air before exhausting it to the outside. However, part of the contaminated air is not processed through this exhaust system. This is because as the web exits the drying unit, a boundary layer of contaminated warm air, which adheres to the upper and lower surfaces of the web, is entrained by the web toward the next processing station, namely, the chill unit. As the web engages the first roller of the chill roll unit, the contaminated warm air may become trapped between the surface of the web and that of the cool chill roller or may condense on the relatively cool surface of the chill roller. As a result, a condensate film, containing contaminants, forms on the surface of the chill roller. This condensate, which is in direct contact with the web, is the source of the "chill streaking" problem commonly occurring in such printing press systems where the image on a web is dried by a hot drying process.

To eliminate the formation of streaking marks on the web, a commonly used approach has been to reduce the speed at which the press operates thereby reducing the amount of contaminants entrained by the web out of the drying unit. Although this approach is successful in most cases, it is, for economical reasons, highly undesirable since throughput of the printing press system is thereby reduced.

Another method to reduce chill streaking consists of increasing the tension to which the web is subjected by the printing press so as to assure a more uniform contact between the web and the chill roller. Under increased web tension, it becomes more difficult for the contaminated air to "lift" the web off the chill roller and, accordingly, condensation on the chill roller is reduced. This method, which gives adequate results under uniform web characteristics, is of limited effectiveness in practice since web characteristics generally vary over a given press run. Accordingly, as the web stretches, a gap will appear between the surface of the web and the surface of the chill roller, allowing condensation to form therebetween. Conversely, increasing web tension to eliminate the gap between the chill roller and the web in order to reduce chill marking increases the likelihood of web breakage.

Other approaches have been tried to eliminate chill marking by either invasively removing the condensate deposit from the chill roller, as by wiping, or by preventing formation of condensate while keeping the press operating under normal speed and web tension conditions. An example of a system using the former approach is illustrated in a sales brochure entitled "Chill Roll Cleaner, Model 1301," by Baldwin.

FIG. 2 shows a section view of a prior art chill roll cleaner representative of the Model 1301 Baldwin device. In FIG. 2, a chill roll cleaner 217 is mounted on a first chill roller 115 of a chill unit 114 and continuously cleans first chill roller 115 by pressing an absorbent material 223 against the surface of chill roller 115. Absorbent material 223 of chill roll cleaner 217 is dispensed by a feed roller 219. Soiled absorbent material 223 is collected over a collect roller 221. The frequency of advance of collect roller 221 is adjusted by the pressman as necessary to achieve adequate cleaning of chill roller 115.

Such an invasive system offers increased safety and some degree of automation over manual cleaning, since manual cleaning requires the pressman, during operation of the chill unit, to manually sweep the condensate film off the chill roller. However, invasive prior art systems have disadvantages. First, as with manual sweeping, the condensate film is removed through an invasive process, that is, a cleaning material makes direct contact with the surface of the chill roller. Direct contact with the surface of a chill roller increases the risk of damaging the chill roller as dust particles trapped between the cleaning material and the chill roller are continually dragged over the same area of the chill roller surface, eventually leading to a press shut-down to resurface or replace a damaged chill roller. Second, such an invasive chill roll cleaner system generally results in additional or longer press down-time when a new cleaning material feed roller needs to be installed. Finally, special procedures for proper disposal of soiled cleaning material must be followed as the condensate, which contains ink solvents and combustion products may be considered a toxic waste.

Another attempt to deal with the chill streaking problem has been to prevent formation of the condensate deposit on the chill roller without increasing web tension as by forcing web-to-roll contact. An example of a system using this forced contact approach is illustrated in a sales brochure entitled Chill Jets® by TEC Systems.

FIG. 3 shows a section view of a prior art system representative of a forced contact system mounted on a first chill roller 115 of a printing press chill unit 114. In FIG. 3, a high pressure, air jet 321 is discharged from a nozzle 323, against the surface of web 110 and toward first chill roller 115. Web 110 is thereby forced into contact with the surface of chill roller 115. As a result, web "lift off" is reduced which squeezes the contaminated air from between the surface of web 110 and chill roller 115, thereby preventing condensate streaking.

Although such prior art forced contact systems, which discharge an air flow against the upper web surface (i.e., the surface which does not make contact with the chill roller) to force contact between the lower surface and the chill roll, are adequate in certain cases, the operation cost of such systems is high since such a system requires high pressure air for operation. In addition, the present inventors have determined that such forced contact systems are inadequate in applications using heavy, high quality webs, or in applications involving dense or thick ink coverage. The inventors believe that such inadequacy is probably due to the fact that forced contact systems are not effective in controlling web instability (induced by web flutter and web weave). The forced contact approach is therefore unable to keep the web uniformly in contact with the chill roller so that the contaminated air is allowed to come in contact with the chill roller and condense upon the chill roller. The limited effectiveness of such a forced contact approach is particularly apparent in high quality printing jobs where heavier webs are generally used.

Such forced contact systems may also contribute to environmental contamination by dispersing the contaminated air in an associated pressroom environment.

Thus, a non-invasive, low operating cost system is needed to reduce the formation of chill roll condensate in order to facilitate production of high quality printed images without sacrificing press speed or increasing web tension, and without exacerbating contamination of the pressroom environment.

SUMMARY OF THE INVENTION

The present invention facilitates reduction of chill streaking problem on a moving web being imprinted in a printing press system by dispersing contaminants from the surface of the web, thereby preventing the formation of chill marks. By preventing condensation of the contaminated warm air entrained by the web upon the chill roller, the formation of chill marks is avoided. In accordance with one aspect of the present invention, a chill roll air bar is disposed proximate the web between the drying unit and the chill unit of a printing press system.

In accordance with a further aspect of the present invention, the amount of contaminated air dispersed in the pressroom atmosphere may be reduced. In a preferred embodiment of the present invention, a chill roll air bar may be disposed proximate the lower surface of the web, by which lower surface the contaminated air is generally entrained. The air bar may be disposed immediately downstream of the drying unit to force the contaminated air back into the drying unit as it is separated from the surface of the web to most effectively reduce dispersion of contaminants in a pressroom.

Other objects and advantages of the present invention will become apparent from the detailed description given hereinafter. It should be understood, however, that the detailed description and specific embodiments are given by way of illustration only, since, from this detailed description, various changes and modifications within the spirit and scope of the invention will become apparent to those skilled in the art.

BRIEF DESCRIPTION OF THE DRAWINGS

A preferred exemplary embodiment of the present invention will hereinafter be described in conjunction with the appended drawings, wherein like numerals denote like elements, and.

DETAILED DESCRIPTION OF A PREFERRED EXEMPLARY EMBODIMENT

Figure 1:
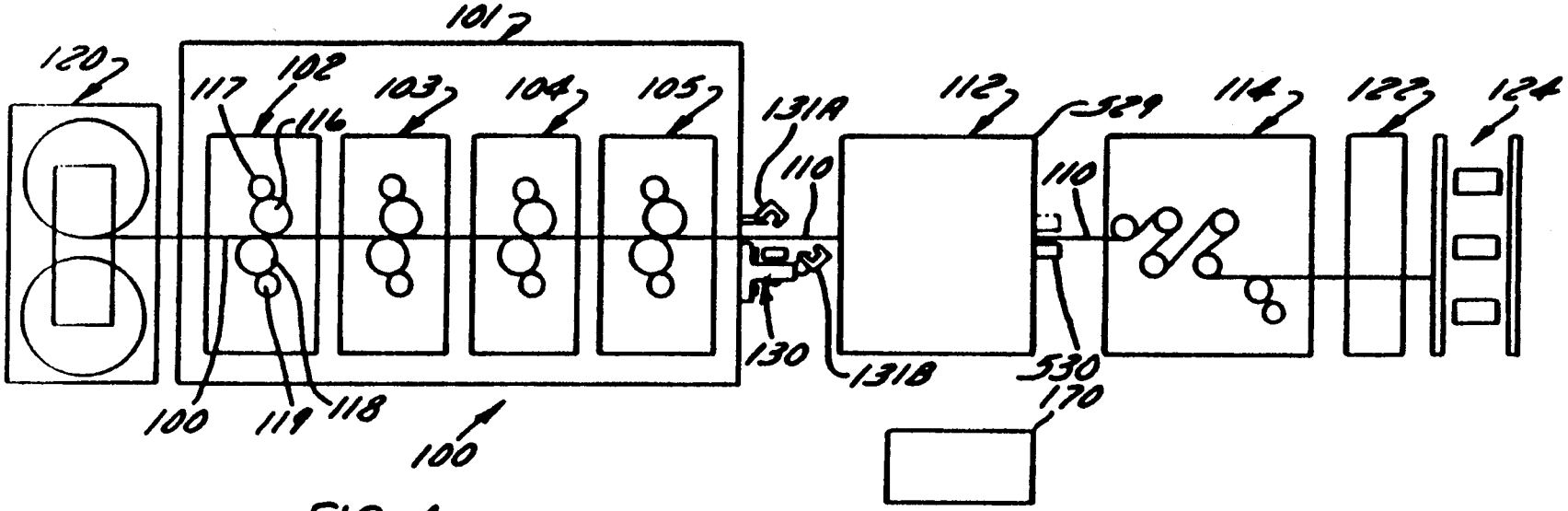
FIG. 1 is a schematic block drawing of a front elevation view of a printing system employing the present invention.

Referring now to FIG. 1, a web-fed printing system 100, preferably including a printing press 101 and comprising a plurality of serially disposed conventional printing units 102, 103, 104 and 105, operates upon a web 110 driven at a first velocity in a web processing direction. In a web offset printing press, each of printing units 102–105 advantageously includes an upper blanket cylinder 116, an upper plate cylinder 117, a lower blanket cylinder 118, and a lower plate cylinder 119. Web 110, typically paper, is fed from a reel stand 120 through each of printing units 102–105 in sequence and thereafter through a dryer unit 112 and chill unit 114. Web 110 is then suitably guided through a coating unit 122 and a folding station 124 which folds and separates the web into individual signatures.

Printing units 102–105 cooperate to imprint multicolor images on the upper and lower surfaces of web 110. Each printing unit 102–105 prints an associated color of ink. Each of the lateral and rotational positions of upper and lower plate cylinders 117, 119 is separately controlled by electric motors (not shown) to precisely register the respective images generated by the individual printing units.

In the embodiment of FIG. 1, a non-invasive stabilizer bar 130, located between press 101 and dryer 112, is employed to facilitate scanning of the web without causing the image imprinted on the respective surfaces of web 110 to smear. One or more optical scanning units aG, 131B, associated with a register control system 170, such as, for example, a Quad/Tech RGS IV Register Control System, are disposed to scan web 110 in a stabilized area in the vicinity of stabilizer 130. Register control system 170 provides appropriate signals to the electric motors of the plate cylinders to precisely control lateral and rotational position of the upper and lower plate cylinders, respectively.

In accordance with one aspect of the present invention, a chill roll air bar 530 is employed to reduce condensate streaking of web 110 as web 110 is cooled through chill unit 114. Chill roll air bar 530 is preferably disposed between dryer unit 112 and chill unit 114, immediately at the exit of dryer unit 112, but may be located anywhere intermediate the exit of dryer unit 112 and the entrance of chill unit 114. In the embodiment illustrated in FIG. 1, chill roll air bar 530 is disposed underneath web 110 and is advantageously mounted to a side frame 529 of dryer unit 112.

Figure 4:
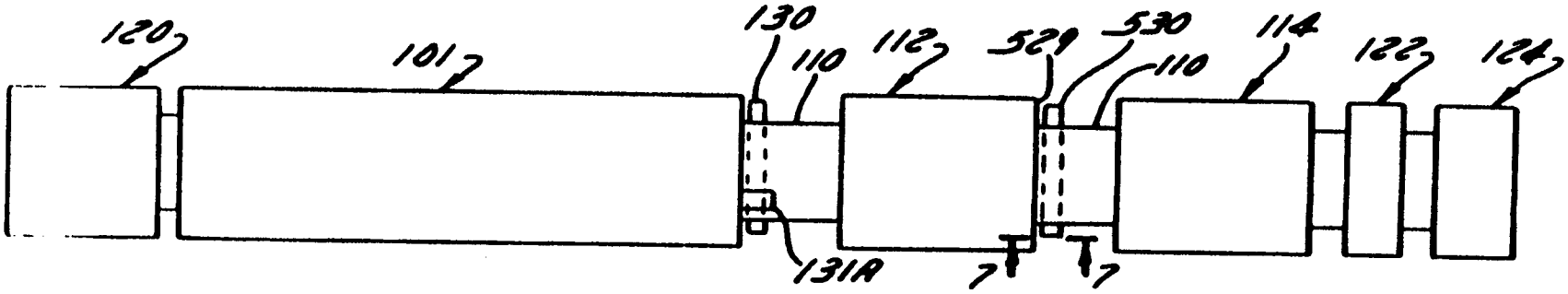
FIG. 4 is a top plan view of the printing press of FIG. 1.
Figure 2:
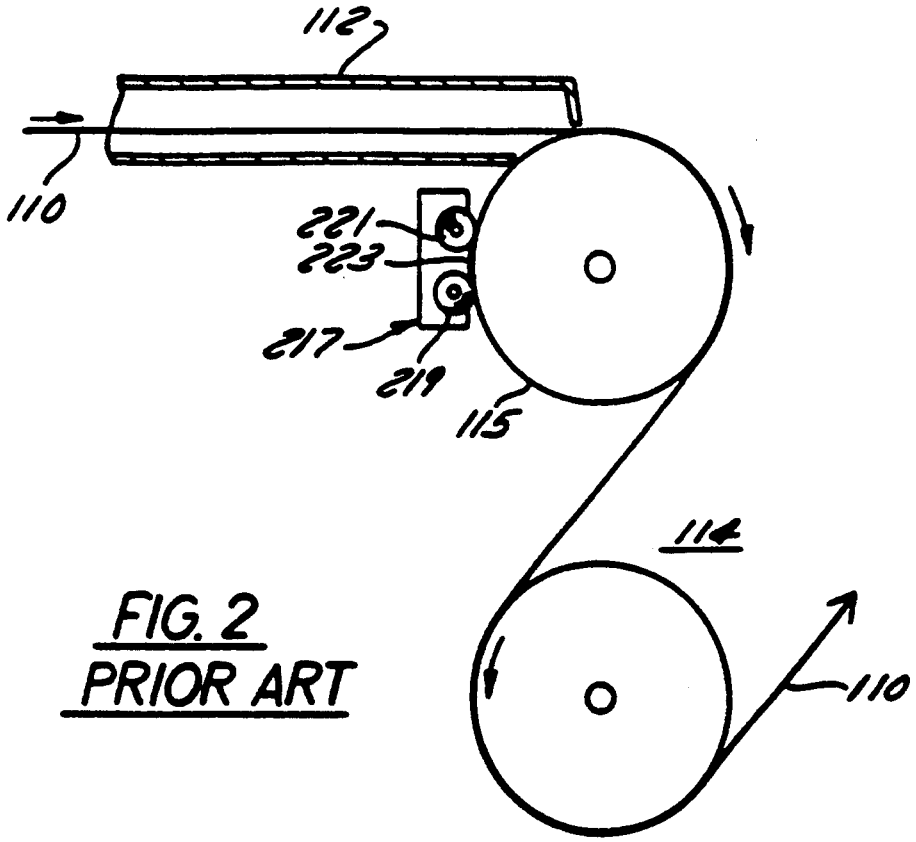
FIG. 2 PRIOR ART
FIG. 2 is a section view of a prior art condensate streaking reduction system.
Figure 3:
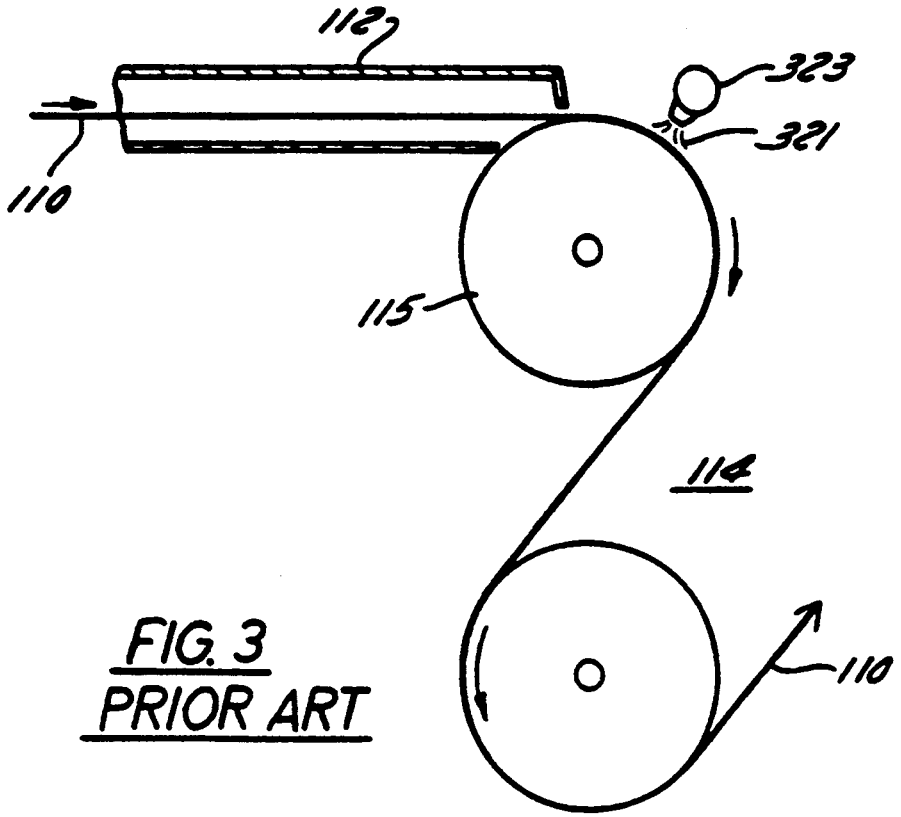
FIG. 3 PRIOR ART
FIG. 3 is a section view of another prior art condensate streaking reduction system.
Figure 5:
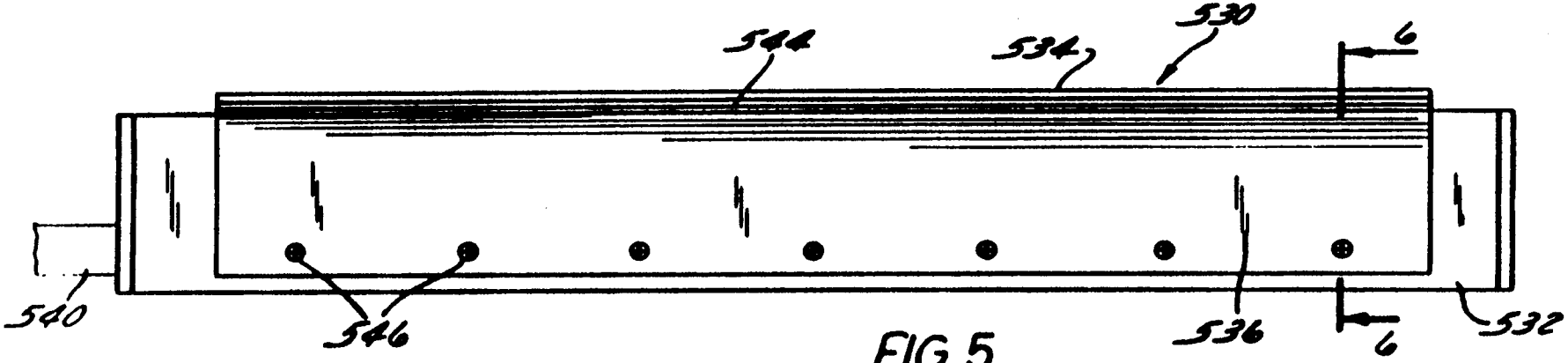
FIG. 5 is a top plan view of the chill roll bar of FIGS. 1 and 4.
Figure 6:
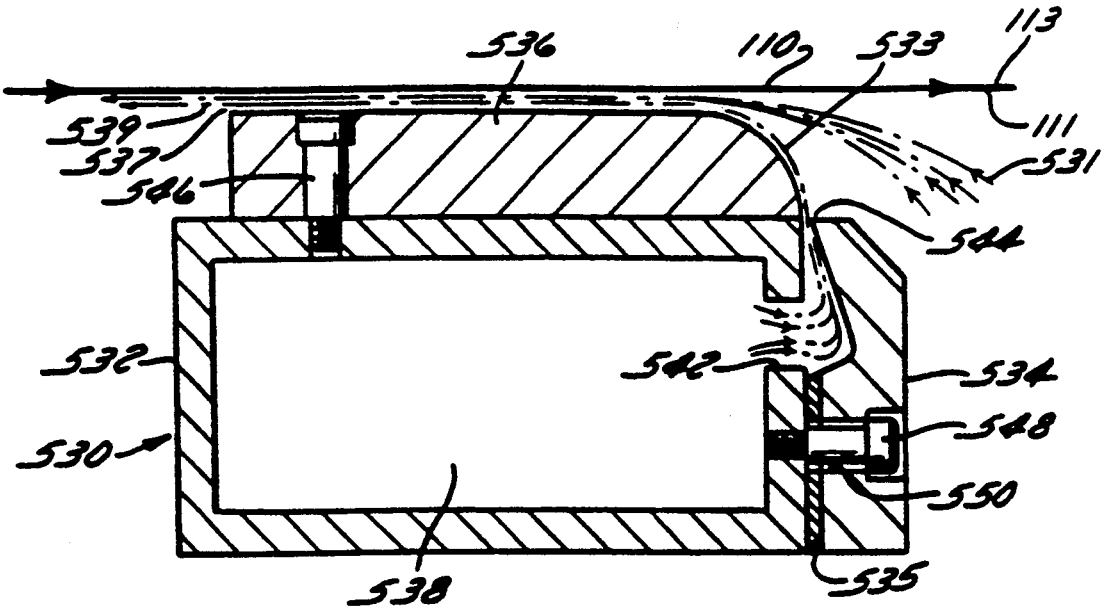
FIG. 6 is a section view of the chill roll bar taken along line 6—6 of FIG. 5.

As shown in FIGS. 4, 5 and 6, chill roll air bar 530 preferably comprises a housing 532 containing pressurized air. Housing 532 is disposed transverse to the web processing direction, and extends substantially across the width of web 110. Chill roll air bar 530 exhausts a high velocity stream 533 of air against a lower surface 111 of web 110. As air stream 533 impinges on moving web 110, air stream 533 moves away from chill roll air bar 530, along the downward facing surface 111 of web 110 with a velocity component substantially parallel but in a direction generally contrary to the web processing direction. In accordance with the "Coanda effect" (which is explained in more detail below in conjunction with FIG. 8), air stream 533 entrains a stream 531 of ambient air. High velocity air stream 533 combines with ambient air stream 531 to create a high velocity, high volume, increased air stream 539. The high velocity (preferably approximately 10 times the velocity of web 110) of increased air stream 539 moving along downward facing surface 111 of web 110 creates, according to the Bernoulli principle[1], a zone of reduced static pressure adjacent lower surface 111 of web 110 and the upper portion of a guiding strip 536 of chill roll air bar 530. As a result of lower pressure in the lower surface 111 of web 110 induced by increased air stream 539, and a relatively higher static pressure present at the upper surface 113 of web 110, web 110 is urged toward guiding strip 536. At the same time, the presence of increased air stream 539 between the lower surface 111 of web 110 and guiding strip 536 prevents web 110 from contacting chill roll air bar 530.

[1] The Bernoulli principle establishes that the sum of static and dynamic pressures is constant at all points where a fluid passes a surface. Thus, an increase in velocity of fluid passing a body (increase in dynamic pressure) yields a decrease in static pressure exerted by the fluid upon the surface.

Accordingly, for example, as flutter may urge web 110 away from the chill roll air bar 530, web 110 is urged towards chill roll air bar 530 because of the Bernoulli effect established by increased air stream 539. Thus, web 110 is substantially stabilized in the vicinity of chill roll air bar 530 and an essentially constant gap 537 is maintained between the upper surface of guiding strip 536 and lower surface 111 of web 110. As a result, increased stream 539 of high velocity air comprising pressurized air stream 533 and entrained air 531, is constantly allowed to move through gap 537, in a direction contrary to the web processing direction. Moreover, as the velocity of increased air stream 539 is significantly greater than the velocity of web 110, the resulting velocity of increased air stream 539 with respect to the velocity of web 110 is appropriately sufficient to separate contaminated air 541 from surface 111 of web 110.

By locating non-invasive chill roll air bar 530, between dryer unit 112 and chill unit 114, increased air stream 539 operates as a non-invasive convective surface device which separates the contaminated air 541, entrained with web 110 out of dryer unit 112, from the lower surface 111 of web 110 before web 110 engages first roller 115 of chill unit 114. As a result, the formation of contaminant condensate on the surface of first chill roller 115 is avoided, thereby reducing "condensate marking" on web 110.

Although it is difficult to quantify this separating/dispersing action, it is, however, possible to estimate its strength by calculating the shear stress applied by increased air stream 539 to surface 111 in separating contaminated air 541 therefrom. More specifically, and as indicated in *Fluid Mechanics*, by Frank White, McGraw-Hill, New York, 2nd ed., p. 306, for ease of calculation, the area along air bar 530, i.e., across the width of web 110, defined by oppositely facing surfaces of guiding strip 536 and lower surface 111, can be modelled as duct flow. Accordingly, the shear stress $\mu$ in that area can be calculated from:

$$\tau = \frac{4\mu U_0}{d} \tag{1}$$

Since, $d = \frac{4A}{p}$, therefore $$\tau = \frac{\mu U_0 p}{A} \tag{2}$$

where:

$\mu$ is the dynamic viscosity of increased air stream 539;

$U_0$ is the velocity of increased air stream 539;

d is the hydraulic diameter of the duct for non-circular ducts;

A is the cross sectional area of the duct (i.e., height of gap 537 multiplied by width of web 110); and p is the wetted perimeter of the cross section (i.e., twice the height of gap 537+twice the width of web 110).

As can be seen from equation (2), the higher the velocity $U_0$ of increased air stream 539 or the smaller the cross sectional area A of the duct, (e.g., the smaller the height of gap 537), the higher the shear stress and the more effective increased air stream 539 will be at separating contaminated air 541 from surface 111.

Reduction of condensate marking is also facilitated by the fact that, in addition to separating contaminated air 541 from web 110, high velocity increased air stream 539 also pre-cools web 110 before web 110 enters chill unit 114. As a result, the temperature differential between web 110 and chill roller 115 is substantially reduced, thereby making condensation of any portion of contaminated air 541 which may remain with web 110 less likely.

In addition to reducing condensate marking, chill roll air bar 530 also reduces wrinkling of the images printed on web 110. Such wrinkling typically occurs during long unsupported spans. However, in the process of dispersing contaminated air 541, chill roll air bar 530 urges web 110 toward chill roll air bar 530 before web 110 enters chill unit 114. As a result of such bending of the path of web 110, wrinkling of the web is substantially reduced.

A plurality of chill roll air bars 530 may be simultaneously employed above and below web 110, if desired. For purposes of clarity of illustration, the preferred embodiment of the present invention has been described in the context of a single chill roll air bar 530 disposed near lower surface 111 of the web 110.

Referring now to FIGS. 5 and 6, housing 532 is suitably rectangular in cross-section and of a length in excess of the width of web 110. A cavity 538 spans the length of housing 532, the cross-sectional area of cavity 538 being sufficient to accommodate a desired air flow. Cavity 538 communicates with a compressed air source (not shown) through an air inlet junction 540 suitably disposed at an end of housing 532, and advantageously in line with the longitudinal axis of housing 532.

A controlled air stream outflow 533 is exhausted from housing 532 toward web 110. A series of air discharge apertures 542 are formed through a side wall of housing 532 along the length of housing 532. Gap adjusting strip 534 and guiding strip 536 are preferably secured to two perpendicular surfaces of housing 532, with adjusting strip 534 partially obstructing apertures 542. A spacer 535 is advantageously disposed intermediate adjusting strip 534 and housing 532. Adjusting strip 534, guiding strip 536, spacer 535 and housing 532, cooperate to define a linear gap 544 between housing 532 and strips 534, 536, preferably of a length corresponding to the width of web 110. Air stream 533 is exhausted from housing 532 through apertures 542 and gap 544, against the facing lower surface 111 of web 110, in a region between air bar 530 and lower surface 111, and in a direction contrary to the web processing direction.

The use of apertures 542, strips 534, 536 and spacer 535 to provide and control air flow is particularly advantageous, providing a structure mechanically strong enough to operate at relatively high air pressures without deformation of the air outlet. Moreover, the rectangular cross-section of housing 532 facilitates formation of apertures 542, and the securing of strips 534, 536 and spacer 535 during manufacture and assembly.

Proper selection of the width of gap 544, allows precise control of the velocity of the discharged air passing therethrough. For a given air pressure within cavity 538, decreasing the width of gap 544 increases the velocity of the discharge air speed; conversely, increasing the width of gap 544, decreases the discharge air speed.

The width of gap 544 is preferably such that gap 544 provides a significant resistance to air flow, greatly in excess of the resistance generated by the presence of web 110 in the vicinity of gap 544. Thus, air flow through gap 544 will be substantially constant across the length of gap 544 whether or not web 110 extends across the entire length of gap 544. Thus, webs of varying widths may be readily accommodated; gap 544 is of a length corresponding to the widest web contemplated to be encountered. The width of gap 544 is preferably on the order of ten to twenty thousandths of an inch (0.010 to 0.020 inch).

Guiding strip 536 is secured to housing 532 in any convenient manner, for example by bolts 546. Alternatively, guiding strip 536 may be held in place by shoulder bolts, welding, or may be formed integrally with housing 532, as desired. Adjusting strip 534, on the other hand, is preferably slidably secured to housing 532, for example by respective shoulder bolts 548, received within slots 550. In this way, the width of gap 544 may be adjusted by appropriate selection of spacer 535 and by disposing and securing strip 534 at a predetermined desired distance from strip 536. Of course, if desired, both strips 534, 536 may be fixedly or adjustably secured to housing 532.

Figure 7:
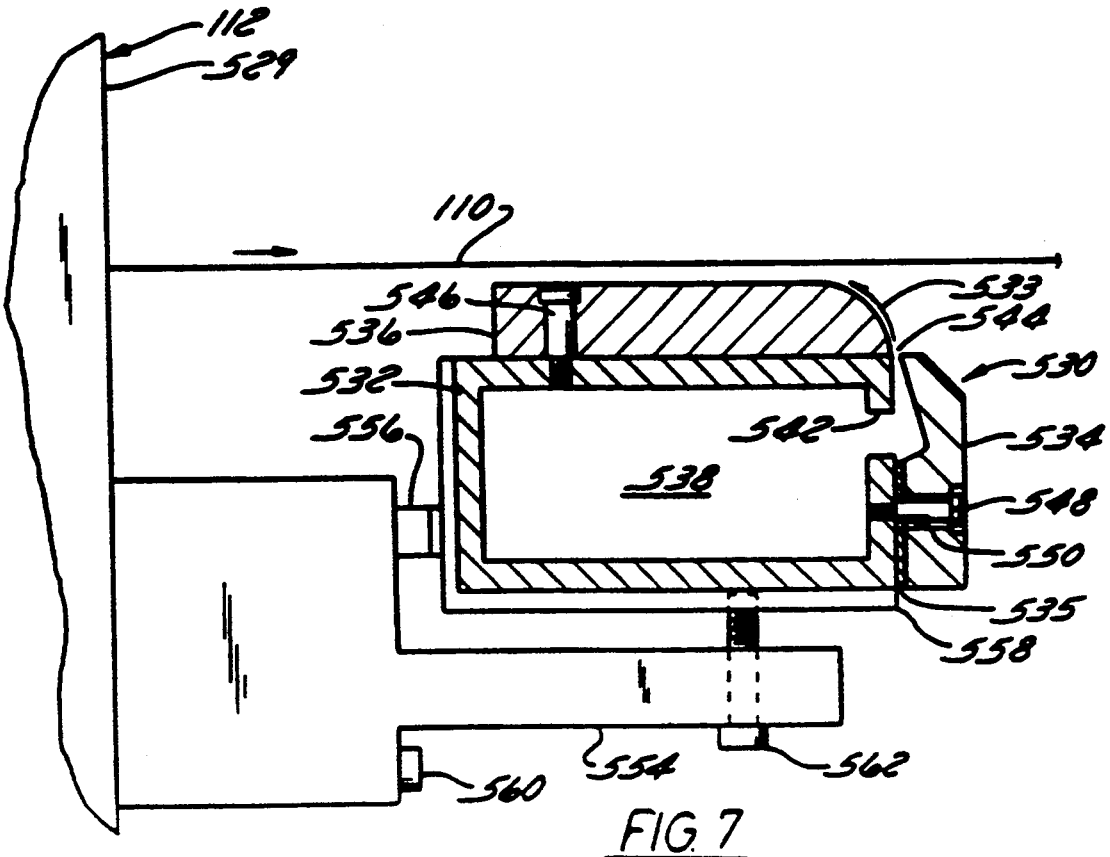
FIG. 7 is a section view of the chill roll bar, shown mounted to the dryer unit, taken along line 7—7 of FIG. 4.

Referring now to FIG. 7, chill roll air bar 530 is advantageously mounted to dryer unit 112 near the point at which web 110 leaves dryer unit 112. In this preferred embodiment, a mounting member 554 is affixed to press frame 529, for example, by an upper bolt 556 and a lower bolt 560. An L-shaped bracket 558 is secured to mounting member 554, for example, by bolt 556 and a bolt 562. Housing 532 is received by L-shaped bracket 558 and secured thereto by, for example, one or both of bolts 556, 562. Mounting member 554 and L-shaped bracket 558 preferably span substantially the entire length of housing 532, and a plurality of bolts 556, 560 and 562 are spaced along the length of mounting member 554 as necessary.

Figure 8:
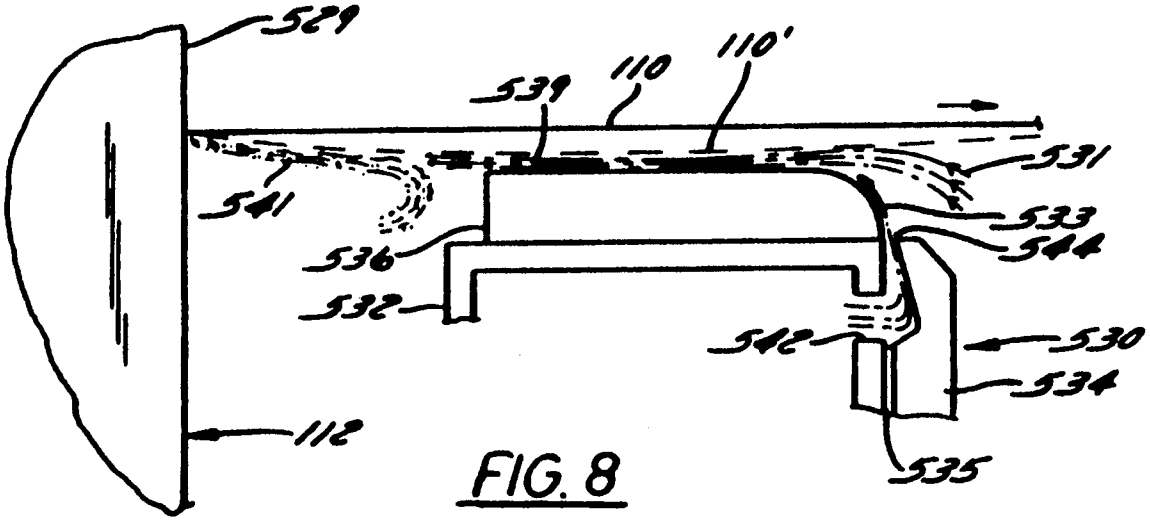
FIG. 8 is an enlarged view of the chill roll bar of FIGS. 5–7 as it is employed in connection with a moving web.

Referring now to FIG. 8, chill roll air bar 530 is advantageously mounted such that the upper surface of guiding strip 536 is disposed in spaced relation from lower surface 111 of web 110 when chill roll air bar 530 is in the off condition. When chill roll air bar 530 is turned on, a stream of compressed air 533 is forced upwardly through respective apertures 542 and gap 544, and is discharged adjacent to the surface of guiding strip 536. In accordance with the coanda effect, compressed air 533 follows the contour of guiding strip 536 and ultimately impinges upon lower surface 111 of web 110 in a direction contrary to the web processing direction. In addition, and also in accordance with the coanda effect, discharged air 533 entrains along with it a large stream of ambient air 531. The pressure of discharged air 533 and of air stream 531, which are both confined between the upper surface of strip 536 and lower surface 111 of web 110, establishes a cushion of horizontally moving air in increased air stream 539. The velocity of increased air stream 539 creates a zone of reduced static pressure between chill roll air bar 530 and lower surface 111 of web 110 in accordance with the Bernoulli principle.

The static pressure on the upper surface 113 of web 110, of course, remains substantially unaffected by the operation of chill roll air bar 530. Consequently, web 110 is urged toward chill roll air bar 530 to a position 110', as indicated in phantom in FIG. 8. The upward force of discharged air 533, in conjunction with the cushion of trapped air in increased air stream 539 between web 110' and guiding strip 536 prevents web 110' from contacting chill roll air bar 530 and maintains a gap 537 between web 110' and chill roll air bar 530. Proper adjustment of web tension, air pressure, and the width of gap 544 permit gap 537 to be maintained preferably within a range of about 0.030 to 0.070 inches, and most preferably to about 0.050 inches. As a result, increased air stream 539, moving through narrow gap 537, separates contaminated air 541 from lower surface 111 of web 110 as web 110 exits drying unit 112. Chill roll air bar 530 also contributes to reducing web instability and increased air stream 539 pre-cools web 110 before web 110 enters chill unit 114.

Figure 9:
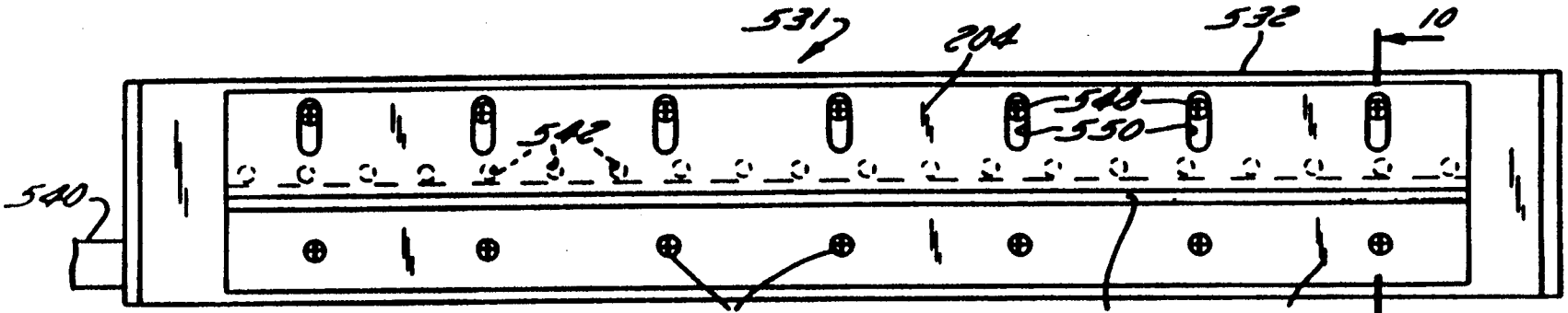
FIG. 9 is a top plan view of an alternate embodiment of the chill roll bar of FIGS. 1 and 4.
Figure 10:
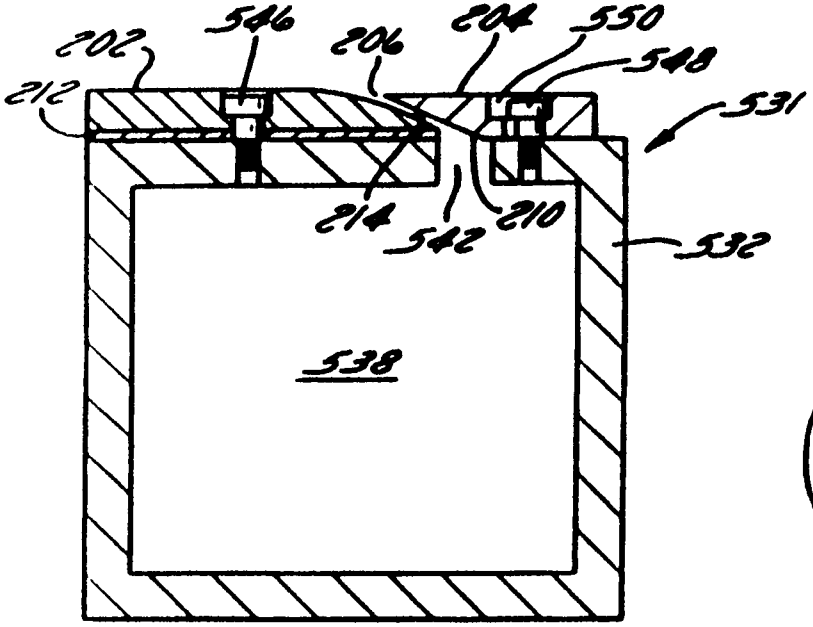
FIG. 10 is a section view of the chill roll bar of FIG. 9 taken along line 10—10 of FIG. 9.

Referring now to FIGS. 9 and 10, an alternate exemplary embodiment of chill roll air bar 531 in accordance with the present invention suitably comprises guiding strip 202 and adjusting strip 204 defining an angled air gap 206. Adjusting strip 204 is suitably secured to housing 532 by shoulder bolt 548 received within slot 550.

Adjusting strip 204 advantageously comprises an angled portion 210 defining an acute angle with the surface of housing 532 upon which respective apertures 542 are disposed. Guiding strip 202 is advantageously secured to housing 532 in any convenient manner, for example by bolts 546. A spacer 212 is advantageously disposed intermediate guiding strip 202 and housing 532 such that, when chill roll air bar 531 is mounted to side frame 529 of dryer unit 112, as illustrated in FIG. 11, the height of guiding strip 202 exceeds that of adjusting strip 204 by an amount approximately equal to the thickness of spacer 212.

Figure 11:
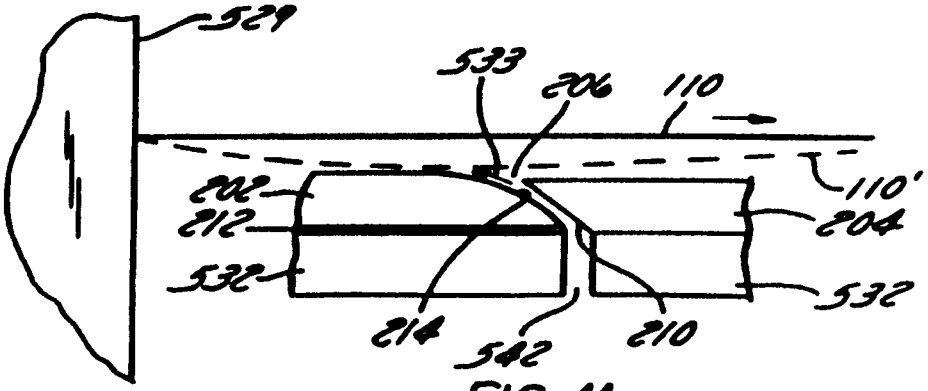
FIG. 11 is an enlarged view of the chill roll bar of FIGS. 9–10 as it is employed in connection with a moving web.

With continued reference to FIGS. 9–11, guiding strip 202 comprises an inclined portion 214 defining an "upstream" edge of gap 206; angled portion 210 of adjusting strip 204 comprises the "downstream" edge of gap 206. ("Upstream" and "downstream" locations are identified with respect to the web processing direction). When chill roll air bar 531 is turned on, a stream of compressed air 533 is forced upwardly through respective apertures 542 and gap 206, and is discharged adjacent to the surface of guiding strip 202. Compressed air 533 follows the contour of guiding strip 202, and ultimately impinges upon lower surface 111 of web 110, in a direction contrary to the processing direction. In this manner, a relatively insignificant amount of discharged air 533 enters the region between web 110 and the upper surface of strip 204, the majority of discharged air 533 being effectively directed between lower surface 111 of web 110 and guiding strip 202. Consequently, the Bernoulli effect is largely confined to that portion of chill roll air bar 531 upstream of gap 206. As with the preferred embodiment illustrated in FIGS. 5–8, contaminated air 541 is separated from lower surface 111 of web 110 upstream of gap 206 from which air stream 533 is discharged as web 110 exits drying unit 112.

In accordance with one aspect of the present invention the inventors have determined that by positioning the chill roll air bar sufficiently close to the exit of drying unit 112, in addition to reducing condensate marking, another problem associated with chill streaking is also advantageously addressed. Namely, contamination of the pressroom atmosphere is reduced.

With reference to FIG. 8, as contaminated air 541, containing evaporated ink solvents, gases from the combustion in the drying unit as well as evaporated moisture from the web, is separated from lower surface 111 of web 110, chill roll air bar 530 forces contaminated air 541 back into drying unit 112, thereby reducing dispersion of contaminants in the pressroom atmosphere.

It is understood that the above description is of preferred exemplary embodiments of the present invention, and that the invention is not limited to the specific forms described. For example, the chill roll air bar need not be secured to the side frame of the dryer unit; the chill roll air bar may be disposed at any convenient point along the web path between the dryer unit and the chill unit, although proximity to the source of pressroom atmosphere contaminants (i.e., the drying unit) is advantageous. Furthermore, although the preferred embodiments employ the Bernoulli-effect, any apparatus configured for separating the contaminated air from the web surface without contacting the web is considered to be within the scope of the present invention. In addition, any suitable fluid may be used in place of air, for example, in the event certain gases may be desirable for effecting or preventing various chemical reactions with the web or any coatings applied thereto. If desired, the fluid stream exhausted from the chill roll air bar may itself be chilled to enhance cooling of the web. In particular, the present invention contemplates webs other than those used in the printing process. For example, systems used in fabricating webs of fabric, wallpaper, floor covering, sheet metal, or any other process in which a flexible web cooperates with one or more processing stations including a drying station which may induce condensate marking on a moving web. These and other substitutions, modifications, changes and omissions may be made in the design and arrangement of the elements without departing from the scope of the appended claims.

We claim:

1. A method for dispersing contaminants in a web processing system, said web processing system including a web processing structure, said web processing structure being in an environment having an ambient first pressure, said web approaching said web processing structure in a processing direction at a first velocity, said web being substantially planar and presenting a first surface and a second surface bounded by two edges, said first surface engaging said web processing structure before said second surface as said web moves in said processing direction, said contaminants being proximate to at least said first surface, the method comprising the steps of:

disposing a fluid exhaust means proximate said first surface at a locus within said web processing system before said first surface engages said processing structure;

connecting said fluid exhaust means to a source of fluid, said source of fluid containing a fluid at a second pressure, said second pressure being greater than said first pressure;

exhausting said fluid from said source through said fluid exhaust means to establish a stream of said fluid having a second velocity, said second velocity being greater than said first velocity; and directing said stream against said first surface so that the vector sum of said first velocity and said second velocity yields a resultant velocity with respect to said web, said resultant velocity creating a zone of reduced static pressure adjacent the first surface of the web and the fluid exhaust means, the reduced static pressure urging the web toward the fluid exhaust means and being appropriate to disperse at least those of said contaminants proximate said first surface.

2. A method for controlling the presence of contaminant gases entrained by a web in a web processing system, the web processing system including a web processing structure, said web processing structure located in an environment having an ambient first pressure, wherein the web approaches the web processing structure in a processing direction at a first speed, wherein the web is substantially planar and presents first and second surfaces bounded by two edges, wherein the first surface engages the web processing structure before the second surface as said web moves in the processing direction, and wherein the contaminant gases are proximate to at least the first surface of the web, the method comprising the steps of:

providing a fluid exhaust means proximate the first surface at a location within said web processing system before said first surface of the web engages the processing structure, to define a duct area between the first surface of the web and the fluid exhaust means;

connecting said fluid exhaust means to a source of fluid at a fluid pressure which is greater than the first pressure;

exhausting fluid from the source of pressurized fluid through the fluid exhaust means to establish a flow of fluid having a speed greater than the speed of the web; and directing the flow of fluid through the duct area in a direction substantially parallel to and opposite the direction of travel of the web, the flow of fluid being directed to establish shear stress on the contaminant gases entrained by the web to separate at least those contaminant gases from proximate the first surface of the web.

* * * * *